United States Patent [19]

Stiller et al.

[11] Patent Number: 4,598,721

[45] Date of Patent: Jul. 8, 1986

[54] METHOD AND APPARATUS FOR PRODUCING CRIMPED FIBRE PIECES OF RECONSTITUTED TOBACCO

[75] Inventors: Wilfried Stiller, Holm; Jörn Ulrich, Bönningstedt; Hartwig Sibbers, Hamburg, all of Fed. Rep. of Germany

[73] Assignee: B.A.T. Cigaretten-Fabriken GmbH, Hamburg, Fed. Rep. of Germany

[21] Appl. No.: 665,838

[22] Filed: Oct. 29, 1984

[30] Foreign Application Priority Data

Oct. 28, 1983 [DE] Fed. Rep. of Germany ..... 3339247

[51] Int. Cl.[4] ..... A24B 3/14

[52] U.S. Cl. ..... 131/375

[58] Field of Search ..... 131/375

[56] References Cited

U.S. PATENT DOCUMENTS

| | | | |
|---|---|---|---|
| 3,203,432 | 8/1965 | Green et al. | 131/375 |
| 3,209,763 | 10/1965 | Parmele et al. | 131/375 |
| 4,164,948 | 8/1979 | Beringer et al. | 131/375 |

*Primary Examiner*—V. Millin

*Attorney, Agent, or Firm*—Armstrong, Nikaido, Marmelstein & Kubovcik

[57] ABSTRACT

For the production of crimped fibre pieces from reconstituted tobacco a mixture of tobacco dust and/or tobacco waste, binders and possibly additives is extruded by a special die or nozzle head to filiform intermediate products with preferably rectangular to slightly lenticular cross-section which immediately after leaving the die head can be cut to give crimped fibre pieces. For forming this crimping no further operation is necessary.

16 Claims, 9 Drawing Figures

METHOD AND APPARATUS FOR PRODUCING CRIMPED FIBRE PIECES OF RECONSTITUTED TOBACCO

BACKGROUND OF THE INVENTION

1. Field of the Invention

The invention relates to a method and apparatus for producing crimped or curled fibre pieces of reconstituted tobacco of the type set forth.

2. Description of the Prior Art

Since the beginning of the fifties, in the tobacco industry both the tobacco dust occurring in the production and tobacco waste have been reprocessed and for example made into tobacco sheets which are then cut and supplied to the tobacco preparation in parallel with the tobacco. An overview of the various physical/-chemical and processing possibilities is given in the article "Use of Reconstituted Tobacco has Soared", published in "Tabak Journal International", No. 2, 1981, page 84 et seq.

For the chemical engineering of the reprocessing of tobacco various possibilities have been developed; for example the published European Patent Application No. 0039647 proceeds from an apparatus in which the reprocessed tobacco composition is compressed by the screw of an extruder in a tapering outlet region and then pressed through a die plate before which a cutting blade is disposed. A disadvantage is the relatively high cleaning expenditure because for thorough cleaning of this extruder the entire apparatus must be dismantled. In addition, only rectilinear fibre pieces are produced which must be added to the tobacco preparation to give them the desired form corresponding to the tobacco fibres.

A particular constructional expenditure is required for one variant described in which the entire extruder is led past the rotating blade in a reciprocating pivotal movement.

A method and apparatus of the type set forth is disclosed in German Patent Specification No. 1,432,567, in which the thread-like intermediate products must be subjected to a subsequent very complicated post-processing to obtain the desired crimped fibre pieces. For this purpose the filamental intermediate products, which have a circular cross-section, must be rolled to intermediate products with flat cross-section and then dried in an air drier, this finally giving the crimped fibre pieces.

SUMMARY OF THE INVENTION

The invention is therefore based on the problem of providing a method and an apparatus for producing crimped fibre pieces from reprocessed or reconstituted tobacco of the type indicated in which the aforementioned disadvantages do not occur.

In particular, it is the object of the invention to provide a method and an apparatus in which without appreciable additional expenditure crimped fibre pieces having the desire dimensions can be produced.

According to one aspect the invention proposes in a method of making crimped fibre pieces from reprocessed tobacco, in which tobacco dust and/or tobacco waste is processed with binders and possibly additives to a plastifiable mixture, the mixture obtained is extruded to individual filiform intermediate products and the extruded filiform intermediate products are processed to crimped fibre pieces, an improvement in which in an extruder a cylindrical skein of the plastified mixture is shaped to a thin-walled continously widening hollow body and is divided into filiform crimping intermediate products, and in which the filiform crimped intermediate products are separated into individual crimped fibre pieces.

According to a further aspect the invention provides in an apparatus for producing crimped fibre pieces from reprocessed tobacco comprising a mixer for tobacco dust and/or tobacco waste, binders and possibly additives, an extruder for the mixture obtained, a die head on the extruder for producing filiform intermediate products, and a means for dividing the filiform intermediate products into crimped fibre pieces, the improvement in which the die head comprises an insert having a cylindrical initial region and a frusto-conically widening end region, in which the outer surface of the frusto-conical end region is provided in the face region with outlet grooves, and in which directly in front of the die head a cutting means is disposed for the emerging filiform intermediate products.

The advantages achieved with the invention are due in particular to the fact that on cutting the filiform intermediate products leaving the die head the desired crimped fibre pieces are obtained whose dimensions and behaviour, in particular in the cigarette making machine, are adapted to the corresponding properties of cut tobacco so that they can for example be supplied directly to cigarette manufacturing, i.e. need not pass through the tobacco preparation.

Due to the streamlined configuration of the die or nozzle head which is achieved by the method step of shaping the plastic skein-like tobacco composition to a thin-walled tube, a considerable reduction of the danger of blockage is achieved, i.e. such an extruder can be operated with relatively long maintenance intervals because trouble occurs only very rarely.

The thin-walled tube is not separated into individual fibres until just before leaving the apparatus according to the invention and consequently due to the guiding of the plastic composition and the angle of the insert filiform crimped intermediate products are obtained which only need to be separated into individual crimped fibre pieces before the crimping is reduced or eliminated by the weight of the filiform intermediate products, increasing with their length.

The thin exit grooves and the entire die head may be easily cleaned because for this purpose it is only necessary to remove the insert, the surfaces to be cleaned then being easily accessible.

Any blocking of the thin exit grooves can also be easily obviated during the operation because for this purpose it is only necessary to slightly turn the insert; the shearing forces thus resulting detach the adhering material so that it can be entrained by the emerging composition.

In this manner, a simple circular skein die head of a conventional laboratory extruder can be converted for making the crimped fibre pieces by securing, for example screwing, such an insert directly in the mouth of the die head.

The outlet grooves should be shaped so that the cross-section of the emerging filiform intermediate products deviates as much as possible from the circular cross-section because in this manner due to the inherent dimensions of the product during the cooling from the plastic to the solid state a very pronounced twisting or crimping of the tobacco fibres can be achieved.

A particularly good crimping of the fibre pieces is obtained if on exit from the die head they have a flat rectangular to slightly lenticular cross-section and directly after emerging are cut by a rotating blade into pieces having a length of about 10 to 20 mm before the crimping is smoothed (pulled straight) by the weight of the crimped fibre pieces, which increases with their length.

A further improvement of the crimping of the fibre pieces can be achieved in that the rotating blade or the receiving means for the rotating blade have a propeller-like configuration. Due to the turbulent air currents and the mechanical stress on impact on the propeller-like blade the still formable fibre pieces are given an even more irregular spatial contour.

This method is very economical because the individual components can be mixed in the dry state and thereafter the composition brought to a moisture content of about only 16% by adding liquid, in particular water. Thus, in contrast to other methods no paste, slurry or granulate is necessary.

The finished crimped fibre pieces have after the cooling from the temperature between 130 and 160° C. as is usual in the die head to the ambient temperature a moisture content of 10 to 12% so that no additional drying operation is necessary.

The crimped fibre pieces should have a thickness of 0.1 to 0.3 mm, in particular 0.15 to 0.25 mm, a width of 0.4 to 3 mm, in particular 0.6 to 1.5 mm and a stretched length of 5 to 40 mm in particular 8 to 20 mm; they may be made from tobacco particles having a maximum particle size of 0.5 mm (i.e. tobacco particles which pass through a screen having a mesh width of 0.5 mm) with addition of binders and the additives usual in tobacco processing and admixed without further treatment to the tobacco cut or cigarette tobacco.

BRIEF DESCRIPTION OF THE DRAWINGS

The invention will be explained in detail hereafter with reference to an example of embodiment with the aid of the attached schematic drawings, wherein.

DESCRIPTION OF THE PREFERRED EMBODIMENTS

Figure 1:
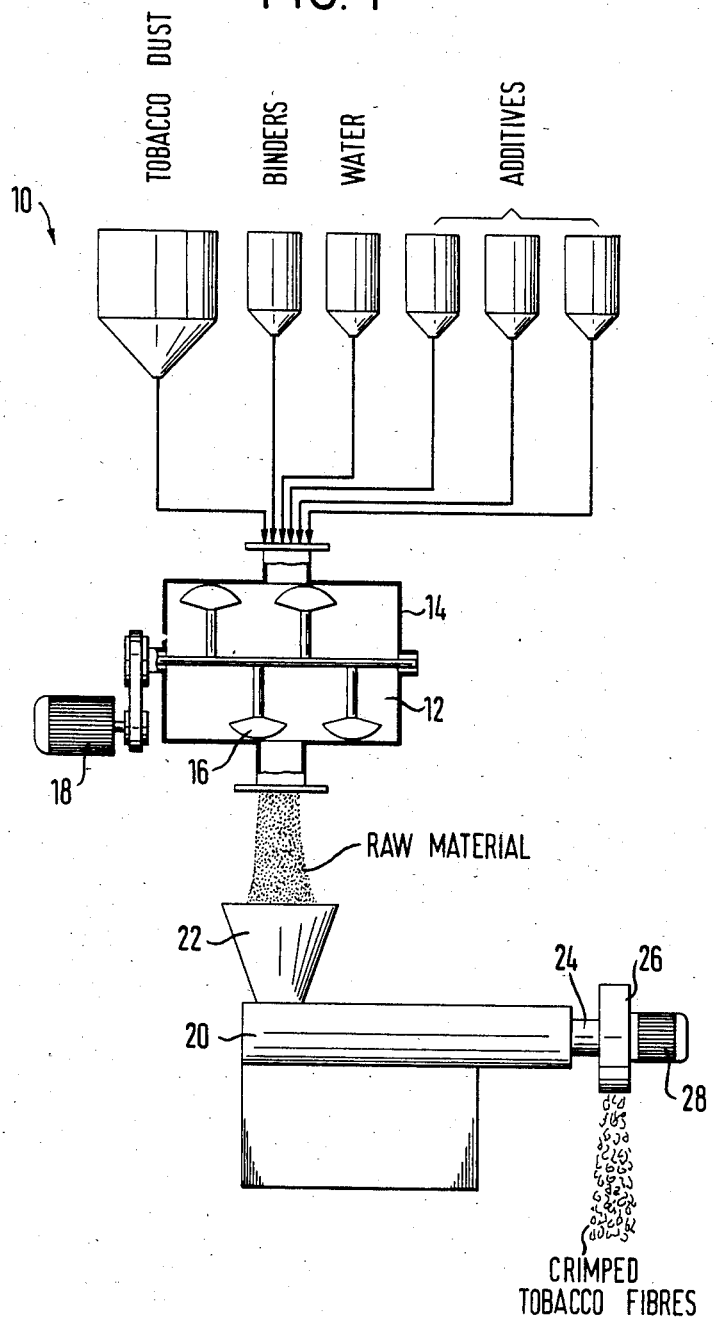
FIG. 1 is an overall view of the apparatus for making crimped fibre pieces from reprocessed tobacco.

The apparatus for making crimped fibre pieces from reprocessed or reconstituted tobacco illustrated in FIG. 1 and denoted generally by the reference 10 comprises a mixer 12 having a housing 14 and a rotating mixing tool 16 which is rotated via a drive motor 18. The components necessary for reprocessing tobacco dust and/or tobacco waste are added to the mixer 12, that is the tobacco dust, binder, water and the conventional additives of the tobacco industry, for example flavouring materials, fillers, substances, influencing the burning, colour-influencing substances, etc.

The pulverulent mixed crude composition delivered by the mixer 12 passes via a funnel 22 into an extruder 20 at the die or nozzle head 24 of which filiform intermediate products emerge. These threadlike intermediate products of the nozzle head 24 are cut by a rotating blade 26 rotated by a drive motor 28 to give the crimped tobacco fibres.

Figure 2:
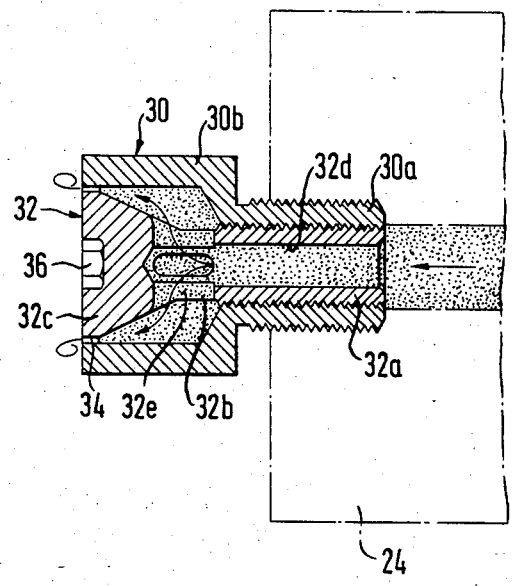
FIG. 2 is a section through the insert and an outer sleeve which surrounds the insert and which can be screwed into the die head of a laboratory extruder.

As apparent from FIG. 2 the die head 24 of the extruder 20 comprises a stepped cylindrical outlet sleeve 30 which consists of a cylindrical inlet region **30*a* and an adjoining cylindrical outlet region 30*b* which has a greater internal diameter than the inlet region 30*a***.

Figure 5:
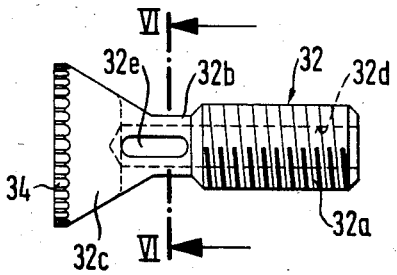
FIG. 5 shows the insert.

Disposed in the outlet sleeve of the die head 24 is an insert 32 apparent in particular from FIG. 5. This insert 32 comprises a cylindrical inlet region **32*a* whose outer diameter is somewhat smaller than the inner diameter of the inlet region 30*a* of the outlet sleeve 30, an adjoining substantially cylindrical transition region 32*b* and a frusto-conically widening end region 32*c* whose end face is flush with the end face of the outlet sleeve 30**.

Figure 6:
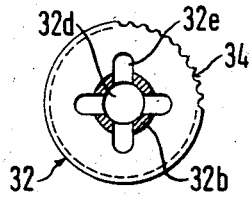
FIG. 6 is a section along the line A—B of FIG. 5.

The cylindrical inlet region **32*a* of the insert 32 is hollow, i.e. comprises a cylindrical through bore 32*d* as apparent in FIGS. 2 and 5. The transition region 32*b* and the start of the frusto-conical end region 32*c* are provided with four axially extending elongated holes 32*e* (see also FIG. 6) which connect the bore 32*d* with the outer surface of this region of insert 32**.

Figure 3:
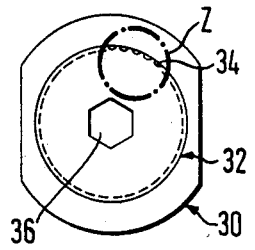
FIG. 3 is a view from the front of the insert and the outer sleeve.
Figure 4:
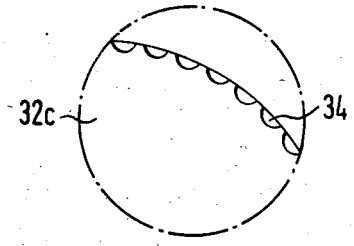
FIG. 4 shows the fragment Z of FIG. 3 to a greater scale.

The face region of the end region **32*c* lying in the illustrated embodiment again on a cylindrical surface is provided with flat rectangular to slightly lenticular outlet grooves 34 (see also FIGS. 3 and 4**).

However, this configuration of the face region is used only for production-technical reasons. In principle it is also possible to form the outlet grooves 34 in an end region **32*c* of the insert 32** which is frusto-conical up to the face region.

It has been found expedient for the frusto-conical end region **32*c* to have an opening angle of about 30° to 120°, i.e. if according to the illustration in FIGS. 1 and 2** the conical surface extends at an angle of about 15° to 60° to the cylinder axis. Particularly good results were obtained with an angle of 22.5° between the cylinder axis and frusto-conical surface.

In the embodiment illustrated the insert 32 is screwed by means of the hexagon 36 into the outlet sleeve 30 which is in turn screwed to the mouth of the die head 24 of a suitable extruder.

Alternatively, the insert 32 can be screwed directly, i.e. without outlet sleeve 30, into the mouth of a suitably formed die head of an extruder, for example a circular skein extruder.

Figure 7:
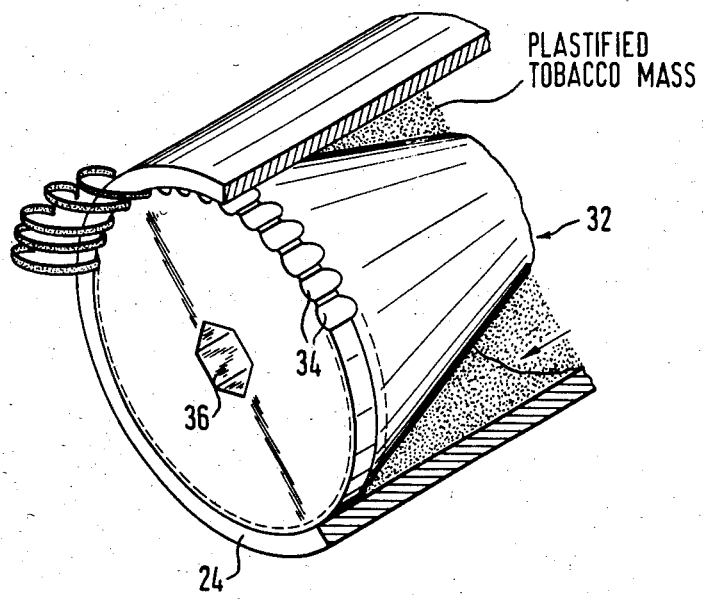
FIG. 7 is a perspective view of the frusto-conical end portion of the insert and the cylindrical outer sleeve.

The cylindrical skein provided by the extruder not shown in detail passes through the bore **32*d* of the insert 32 and then through the elongated holes 32*e* into the gap between the cylindrical transition region 30*b* of the outlet nozzle 30 and the transition region 32*b* of the insert 32 and flows further along the surface of the frusto-conical end region 32*c*, thus being formed to a thin-walled tube with a constantly increasing internal diameter. At the same time, this thin-walled tube is compressed in the narrowing gap between frusto-conical end region 32*c* and outlet region 30*b* of the outlet sleeve 30. Due to this pronounced deformation the plasticised tubular mass has a movement component extending perpendicularly to the cylindrical axis so that from the lenticular outlet grooves 34 which divide the thin-walled tube into individual filaments continuous crimped filaments emerge as apparent from FIGS. 2 and 7**.

Thus, the reprocessed tobacco mass leaves the die head or in a laboratory extruder the connection sleeve 30 as filiform crimped intermediate product which is cut by the rotating propeller-like blade to give the crimped short fibre pieces before the crimping is reduced again or completely eliminated by the weight of the filaments increasing with their length.

As an alternative to the cutting means illustrated the severing of the filiform intermediate products into crimped fibre pieces can also be by a sharp jet of fluid medium, for example an air jet.

Figure 9:
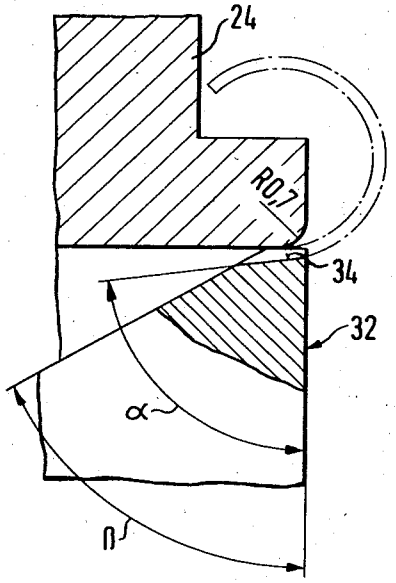
FIG. 9 is a detailed view of the exit portion between insert and nozzle head to a greater scale.
Figure 8:
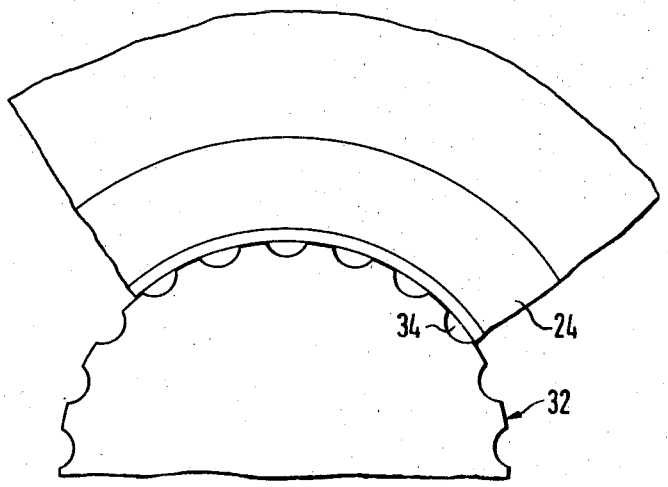
FIG. 8 is a front view of a part of the nozzle head.

Extremely crimped tobacco fibre pieces can be obtained when the exit openings between the outlet grooves 34 on one hand and the opposite wall of the nozzle head 24 or the outer sleeve 30 respectively on the other hand are formed as shown in FIGS. 8 and 9.

As mentioned above the frusto-conical end portion 32*c* extends in an angle $\beta \approx 60°$ with respect to the end face of the insert 32 and ends in the outlet grooves 34 forming an angle of $\alpha \approx 80°$ with the end face of the insert. The angles $\alpha$ and $\beta$ must fulfill the condition:

$$\beta \leqq \alpha \leqq 90°$$

The outlet edge between the outlet grooves 34 on one hand and the end face of the insert 32 on the other hand should be formed as flow breaking edge, i.e., as sharp-edged as possible.

The outlet edge of the cylindrical outer sleeve 30 or the nozzle head 24 respectively opposite said sharp-edged flow breaking edge is rounded and has a radius of 0.3 mm to 5 mm, especially 0.5 mm to 2 mm; in FIG. 9 a radius of 0.7 mm is indicated.

Therefore the end face of the outer sleeve 30 or the nozzle head 24 respectively should be shaped in such a way that the "tobacco fibre" as indicated by the chain lines can curl outwardly without any hindrance. In the embodiment according to FIG. 9, this is achieved by a cut out in the end face. Alternatively, an annular recess can be used.

On operating this apparatus the following physical effect can be observed: The plastified tobacco mass enters the gap between the frusto-conical insert 32 and the outer sleeve 30 or the nozzle head 24 with a relatively low velocity and is accelerated upon reaching the lensshaped outlet grooves 34 to a higher velocity.

The sharp-edged flow breaking edge at the insert 32 and the rounded edge at the nozzle head 24 or the outer sleeve 30 respectively create an effect such that the exiting tobacco fibre follows the rounded edge and is thereby deviated outwardly; this results in a strong unhindered crimping leading to the desired shapes of the fibre pieces.

We claim:

1. In a method of making crimped fibre pieces from reprocessed tobacco, (a) in which tobacco dust and/or tobacco waste is processed with binders and possibly additives to a plastifiable mixture, (b) the mixture obtained is extruded to individual filiform intermediate products and (c) the extruded filiform intermediate products are processed to crimped fibre pieces, the improvement (d) in which in an extruder a cylindrical skein of the plastified mixture is shaped to a thin-walled hollow body of increasing internal diameter and divided into filiform crimping intermediate products, and (e) in which the crimped filiform products are separated into individual crimped fibre pieces.

2. In an apparatus for producing crimped fibre pieces from reprocessed tobacco comprising (a) a mixer for tobacco dust and/or tobacco waste, and binders (b) an extruder for the mixture obtained, (c) a die head on the extruder for producing filiform intermediate products, and (d) a means for dividing the filiform intermediate products into crimped fibre pieces, the improvement, (e) in which the die head comprises an insert having a cylindrical initial region and a frusto-conically widening end region, (f) in which in the face region the outer surface of the frusto-conical end region is provided with outlet grooves, and (g) in which directly in front of the die head a cutting means is disposed for the emerging filiform intermediate products.

3. Apparatus according to claim 2, in which the insert is disposed in the mouth of the die head.

4. Apparatus according to claim 2, in which the insert is disposed in a hollow cylindrical outer sleeve, which is secured in the mouth of the nozzle head.

5. Apparatus according to claim 4, in which the insert is screwed into the outer sleeve.

6. Apparatus according to claim 4, in which the outer sleeve is screwed into the mouth of the die head.

7. Apparatus according to claim 2 in which the frusto-conically widening end region of the insert forms an angle of about 25° to 65°, especially 40° to 50°, with the central axis of the insert.

8. Apparatus according to claim 2 in which the outlet grooves have a flat cross-section differing from the circular form.

9. Apparatus according to claim 8 in which the outlet grooves have a rectangular to slightly lenticular cross-section.

10. Apparatus according to claim 2 in which the cutting means is formed by a rotating propeller-like blade.

11. Apparatus according to claim 2 in which the cutting means is formed by a sharp jet of fluid medium.

12. Apparatus according to claim 2 in which the cutting means is disposed at a distance of about 10 to 20 mm from the die head.

13. Apparatus according to claim 2 in which the outlet edge between the outlet grooves and the end face of the frusto-conical end portion is formed as sharp-edged flow breaking edge.

14. Apparatus according to claim 13 in which the edge of the nozzle head or the outer sleeve respectively opposite said flow breaking edge is rounded.

15. Apparatus according to claim 14 in which the rounded edge has a radius of 0.3 mm to 5 mm.

16. Apparatus according to claim 15 in which the rounded edge has a radius of 0.5 mm to 2 mm.

* * * * *